United States Patent [19]

Ilitch

[11] Patent Number: 4,494,689

[45] Date of Patent: Jan. 22, 1985

[54] CARRYOUT FOOD TRAY

[75] Inventor: Michael Ilitch, Bloomfield Hills, Mich.

[73] Assignee: Little Caesar Enterprises, Inc., Farmington Hills, Mich.

[21] Appl. No.: 513,767

[22] Filed: Jul. 14, 1983

[51] Int. Cl.[3] ..... B65D 5/20

[52] U.S. Cl. ..... 229/30; 206/45.33; 229/19; 229/34 B

[58] Field of Search ..... 229/9, 11, 19, 20, 30, 229/34 R, 31 FS, 34 B; 206/557, 565, 45.33, 45.32

[56] References Cited

U.S. PATENT DOCUMENTS

| | | | |
|---|---|---|---|
| 1,930,896 | 10/1933 | Hause et al. | 229/35 X |
| 2,286,879 | 6/1942 | Thew | 229/30 |
| 2,366,419 | 1/1945 | Meller | 206/45.33 |
| 3,192,050 | 6/1965 | Almquist | 206/45.33 |
| 3,572,577 | 3/1971 | Dorfman | 229/32 |

FOREIGN PATENT DOCUMENTS

| | | | |
|---|---|---|---|
| 471411 | 2/1951 | Canada | 229/35 |
| 66749 | 3/1957 | France | 206/45.33 |
| 1169455 | 9/1958 | France | 206/45.33 |
| 1436430 | 3/1966 | France | 229/30 |
| 545113 | 5/1942 | United Kingdom | 206/45.33 |
| 2086352 | 5/1982 | United Kingdom | 229/30 |

*Primary Examiner*—George E. Lowrance
*Assistant Examiner*—Gary E. Elkins
*Attorney, Agent, or Firm*—Brooks & Kushman

[57] ABSTRACT

A carryout food tray (10) is disclosed as being constructed from a paperboard blank (12) having a central panel (16) of a rectangular shape, a pair of side panels (18) and a pair of end panels (22). Upon construction of the tray, the side panels (18) and the end panels (22) are folded upwardly from the central panel 16 and are secured to each other by tabs (28) and slots (32). The tray prevents contact between carryout food and a bag that receives the tray and also permits food to be served after the tray is removed from the bag without the possibility of the food slipping off the tray upon inclination as it is handled.

7 Claims, 3 Drawing Figures

CARRYOUT FOOD TRAY

TECHNICAL FIELD

This invention relates to a carryout food tray for use with pizza but can also be utilized with other carryout foods.

BACKGROUND ART

Carryout foods such as pizza is packaged in different ways for carrying by the customer from the store for consumption. One way in which carryout pizza is packaged is in a flat cardboard box which has a top that is opened for serving of the pizza. Such boxes advantageously prevent contact with the top of the pizza, but have the disadvantages of being relatively costly and not being particularly easy to use for service of the food since the top gets in the way once it is opened. Another way in which pizza is sold is with a flat cardboard sheet that is inserted into a bag to cover the top of the pizza. While this latter type of packaging is more economical than cardboard boxes, the flat tray does not prevent contact between the bag and the top of the pizza and the pizza is not prevented from slipping off the flat tray when it is inclined.

U.S. Pat. No. 3,476,304 discloses a pizza carton that can be folded to form a tray with sides. However, the construction of this carton involves multiple folds at each carton corner and has never found widespread acceptance.

Other prior paperboard containers are disclosed by U.S. Pat. Nos. 2,151,472; 2,231,515; 2,657,849; and 2,979,250.

DISCLOSURE OF INVENTION

An object of the present invention is to provide an improved carryout food tray that has particular utility when utilized with pizza but can also be utilized with other carryout foods. In carrying out this object, the food tray of the present invention can be stored flat prior to construction for use, has a construction that prevents contact between the top of food on the tray and a bag into which the tray is inserted upon sale of the food for carrying out by the customer, allows convenient service of the food from the tray, and prevents the food from slipping off the tray upon inclination.

The carryout food tray of the invention is comprised by a paperboard blank having a central panel of a rectangular shape. A pair of side panels of the blank have associated foldable scoreline connections to opposite sides of the central panel. A pair of end panels of the blank have associated foldable scoreline connections to opposite ends of the central panel. The side and end panels each have opposite ends positioned in adjacent pairs with the panel ends of each pair spaced from each other at the adjacent corner of the central panel. One of the panel ends of each associated pair includes a tab, while the other panel end of each associated pair includes a slot for receiving the associated tab. Upon construction of the blank into the tray, the side and end panels are folded upwardly and the tabs are received within the associated slots to secure the side and end panels to each other at the corners of the central panel. The constructed tray prevents contact between carryout food on the tray and a bag that receives the tray, and the tray also permits the food to be served after removal from the bag without the possibility of food slipping off the tray when it is inclined.

In the preferred construction, the end panels of the blank include handhold openings that facilitate handling of the tray. The end panels also each preferably have rounded outer edges that facilitate insertion of the construction tray into a bag by providing a shorter height at the side panels adjacent the edges of the bag while providing a greater height midway between the side panels to prevent the bag from contacting the food on the tray. As disclosed, the central panel extending between the end panels has an elongated rectangular shape which has particular utility for carrying an elongated pizza, two round pizzas, or one round or square pizza and additional food.

The ends of each side and end panels include edges that are inclined with respect to the associated scoreline connections thereof to the central panel, with such inclination being in a direction away from the other adjacent panel end such that the upwardly folded side and end panels are inclined inwardly over the central panel with the tabs and slots secured to each other. Each side panel also preferably includes a foldable scoreline extending parallel to the adjacent side of the central panel to define inner and outer side panel portions. The tabs and slots are positioned on the end panels and the outer portions of the side panels such that the outer side panel portions have a greater inward inclination than the inner side panel portions and thereby partially cover the carryout food adjacent the sides of the tray in the constructed condition.

As disclosed, the tabs are provided on the side panel ends and the slots are formed in the end panel ends. Each tab has an ear that retains the tab within the associated slot upon construction of the tray. Any tendency of the side panels to fold back to the flat position along the scorelines further interengages the tab ear with the slot to maintain the constructed condition of the tray.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
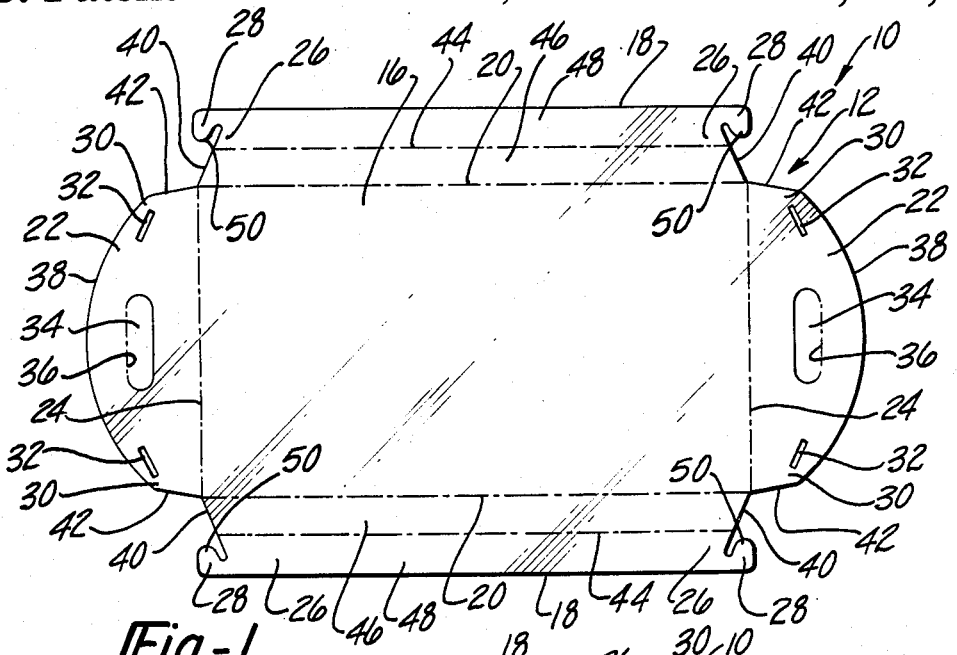
FIG. 1 is plan view of a paperboard blank for constructing a carryout food tray in accordance with the present invention.

With reference to the drawings, a carryout food tray indicated generally by 10 is constructed in accordance with the present invention and is comprised of a paperboard blank which is indicated generally by 12 and may be constructed from any foldable flat sheet material such as cardboard, plastic coated paperboard, or the like. Paperboard blank 12 is illustrated in FIG. 1 in its flat condition and is foldable as is hereinafter more fully described to a constructed condition to provide the tray 10 illustrated in FIG. 2 in order to permit carrying of food on the tray from the store for consumption. Prior to leaving the store, the constructed tray 10 is first inserted into a bag 14. Upon such insertion of the tray, the constructed configuration of the tray prevents the bag from contacting the top of food on the tray during transit. After the tray 10 is removed from the bag 14 for consumption of the food, the tray acts as a server from which the food can be easily served.

Figure 2:
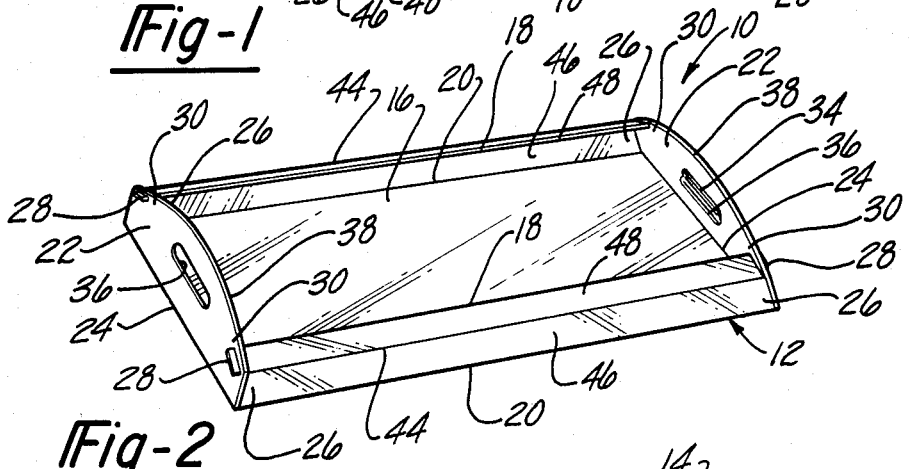
FIG. 2 is a perspective view of the carryout food tray in its constructed condition ready for use.

As best seen in FIGS. 1 and 2, the paperboard blank 12 includes a central panel 16 that has a rectangular shape. A pair of side panels 18 of the blank have associated foldable scorelines connections 20 to opposite sides of the central panel 16. The blank 12 also includes a pair of end panels 22 having associated foldable scoreline connections 24 to opposite ends of the central panel 16. Each of the side panels 18 has opposite ends 26 including associated tabs 28, while each of the end panels 22 includes opposite ends 30 having associated slots 32. At each corner of the central panel 16, the adjacent side and end panel ends 26 and 30 are spaced from each other defining an outwardly opening shape that allows the side and end panels to be folded upwardly.

Figure 3:
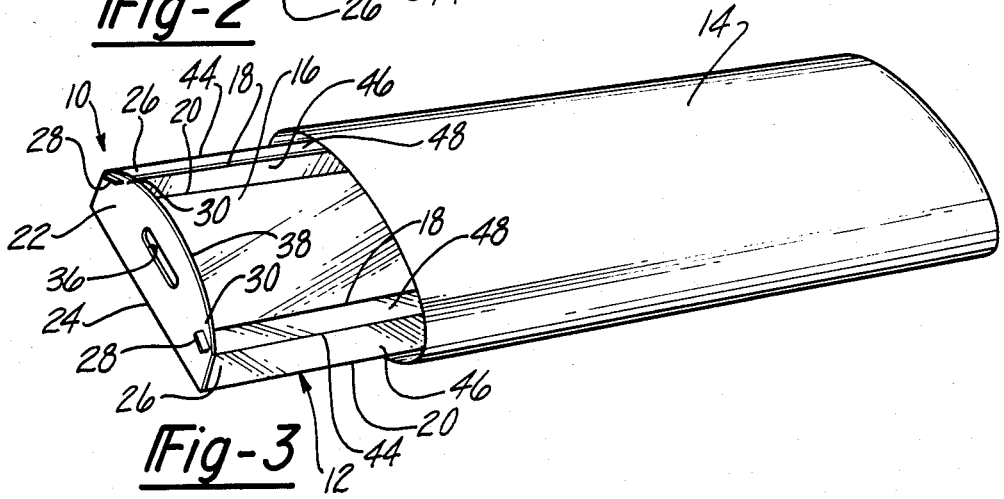
FIG. 3 is a view similar to FIG. 2 of the constructed tray but showing the tray partially inserted into to a bag used for carrying the tray from the store for consumption of the carried food.

Side panels 18 are folded upwardly at scoreline connections 20 and end panels 22 are folded upwardly at the scoreline connections 24 to construct the blank 12 from its flat position shown in FIG. 1 into the tray 10 shown in FIG. 2. Upon such folding, the tabs 28 of the side panel ends are received within the slots 32 in the end panel ends in order to secure the tray in its constructed condition. Upon insertion of the tray 10 into the bag 14 as shown in FIG. 3, the upwardly folded side panels 18 and end panels 22 prevent the bag from contacting the upper side of food on the tray. After removal of the tray 10 from the bag 14, the tray can function as a server from which the food can be conveniently served without the possibility of food slipping off the tray when the tray is inclined.

In the preferred construction, the end panels 22 of the blank 12 are cut to provide handhold portions 34 that are punched out to define handhold openings 36 which facilitate handling of the constructed tray 10. Each of the end panels also preferably has a rounded outer edge 38 that provides a greater tray height midway between the side panels 18 and shorter heights adjacent the side panels in order to facilitate insertion into the bag 14 while still maintaining the bag spaced from the food on the tray.

As best seen in FIG. 1, the ends 26 of side panels 18 each include an edge 40 that is inclined with respect to the associated scoreline connection 20 thereof to the central panel 16. Likewise, the ends 30 of each end panel 22 also includes edges 42 that are inclined with respect to the associated scoreline connections 24 thereof to the central panel 16. The inclination of edges 40 and 42 with respect to the associated scoreline connections 20 and 24 to the central panel is in a direction away from the adjacent inclined panel edge. As such, upon upward folding of the side panels 18 and the end panels 22, the side and end panels are inclined inwardly over the central panel with the tabs and slots secured to each in the constructed condition. Such inward inclination of the side and end panels keeps the bag out of contact with the food at the edge of the tray and also helps in retaining the carryout food on the tray despite tipping of the tray as it is handled.

Each side panel 18 includes a foldable scoreline 44 extending parallel to the adjacent side of the central panel to define inner and outer side panel portions 46 and 48. Tabs 28 are positioned on the outer side panel portions 48 and slots 32 are inclined on the end panels 22 with respect to the scoreline connections 24 such that the outer side panel portions 48 have a greater inward inclination than the inner side panel portions 46 over the central panel 16. Such a construction thus tends to partially cover the side edges of the tray and thereby helps in positioning the bag 14 upwardly away from the top of the carried food at the sides of the tray.

It should be noted that it is also possible for the respective positions of the tabs 28 on side panels 18 and the slots 32 on the end panels 22 to be reversed. However, the construction disclosed is preferred and, in this regard, the tabs 28 are preferably provided with ears 50. Upon construction of the tray and insertion of the tabs 28 within the slots 32, the tendency of the side panels 18 to fold back toward the flat position of the blank further interengages the ears 50 with the slots 32 in order to maintain the constructed condition of the tray.

Also, as disclosed, the tray 10 has its central panel 16 provided with an elongated rectangular shape which has utility for carrying of elongated pizzas, two round pizzas, or one pizza and additional food. This elongated shape also enhances the use of the tray as a server by providing a shape that is convenient to handle and has sufficient area for carrying food.

While the best mode for carrying out the invention has been described in detail, those familiar with the art to which this invention relates will recognize various alternative designs and embodiments for practicing the invention as defined by the following claims.

What is claimed is:

1. A carryout food tray comprising: a paperboard blank having a central panel of a rectangular shape; the blank including a pair of side panels having associated foldable scoreline connections to opposite sides of the central panel; the blank including a pair of end panels having associated foldable scoreline connections to opposite ends of the central panel; said side and end panels each having opposite ends positioned in adjacent pairs with the panel ends of each pair spaced from each other at the adjacent corner of the central panel; each side panel end including a tab; each panel end including a slot for receiving the tab on the adjacent side panel end such that the side and end panels can be folded upwardly and secured to each other at the corners of the central panel in order to prevent contact between carryout food on the tray and a bag that receives the tray and in order to also permit the food to be served on the tray after removal of the bag without the possibility of the food slipping off the tray when it is inclined; the ends of each side and end panel including edges that are inclined with respect to the associated scoreline connections thereof to the central panel; the inclination of the ends of the side and end panels being in a direction away from the adjacent panel ends such that the upwardly folded side and end panels are inclined inwardly over the central panel with the tabs and slots secured to each other; each side panel including a foldable scoreline extending parallel to the adjacent side of the central panel to define inner and outer side panel portions; the tabs being positioned on the outer portions of the side panels at the ends thereof; and the slots being inclined with respect to the scoreline connections of the end panels to the central panel to provide the outer side panel portions with a greater inward inclination than the inner side panel portions.

2. A tray as in claim 1 wherein the end panels of the blank include handhold openings.

3. A tray as in claim 2 wherein the end panels have rounded outer edges that facilitate insertion of the constructed tray into a bag.

4. A tray as in claim 1, 2 or 3 wherein each tab has an ear that retains the tab within the associated slot upon construction of the tray.

5. A carryout food tray comprising: a paperboard blank having a central panel of an elongated rectangular shape; the blank including a pair of side panels having associated foldable scoreline connections to opposite sides of the central panel; the blank including a pair of end panels having associated foldable scoreline connections to opposite ends of the central panel; each end panel having a handhold opening and having a rounded outer edge; said side and end panels each having opposite ends positioned in adjacent pairs with the panel ends of each pair spaced from each other at the corners of the central panel; each side panel end including a tab; each end panel end including a slot for receiving the tab of the adjacent side panel end such that the side and end panels can be folded upwardly and secured to each other at the corners of the central panel in order to prevent contact between carryout food on the tray and a bag that receives the tray and in order to also permit the food to be served on the tray after removal of the bag without the possibility of the food slipping off the tray when it is inclined; the ends of each side and end panels including edges that are inclined with respect to the associated scoreline connections thereof to the central panel; the inclination of the ends of the side and end panels being in a direction away from the adjacent panel ends such that the upwardly folded side and end panels are inclined inwardly over the central panel with the tabs and slots secured to each other; each side panel including a foldable scoreline extending parallel to the adjacent side of the central panel to define inner and outer side panel portions; the tabs being positioned on the outer portions of the side panels at the ends thereof; and the slots being inclined with respect to the scoreline connections of the end panels to the central panel to provide the outer side panel portions with a greater inward inclination than the inner side panel portions.

6. A carryout food tray comprising: a paperboard blank having a central panel of an elongated rectangular shape; the blank including a pair of side panels having associated foldable scoreline connections to opposite sides of the central panel; each side panel having a foldable scoreline extending parallel to the adjacent side of the central panel to define inner and outer side panel portions; the blank including a pair of end panels having associated foldable scoreline connections to opposite ends of the central panel; each end panel having a handhold opening and having a rounded outer edge; said side and end panels each having opposite ends positioned in adjacent pairs with the panel ends of each pair spaced from each other at the corners of the central panel; said side and end panel ends each having edges that are inclined with respect to the associated scoreline connections thereof to the central panel each side panel end including a tab; each end panel end including a slot for receiving the tab of the adjacent side panel end such that the side and end panels can be folded upwardly and secured to each other at the corners of the central panel in order to prevent contact between carryout food on the tray and a bag that receives the tray and in order to also permit the food to be served on the tray after removal of the bag without the possibility of the food slipping off the tray as it is inclined; the inclination of the ends of the side and end panels being in a direction away from the adjacent panel ends such that the upwardly folded side and end panels are inclined upwardly over the central panel with the tabs and slots secured to each other; each side panel including a foldable scoreline extending parallel to the adjacent side of the central panel to define inner and outer side panel portions; the tabs being positioned on the outer portions of the side panels at the ends thereof; and the slots being inclined with respect to the scoreline connections of the end panels to the central panel to provide the outer side panel portions with a greater inward inclination than the inner side panel portions.

7. A tray as in claim 5 or 6 wherein the ear of each tab projects toward the adjacent slot prior to folding of the tray.

* * * * *